US005746584A

United States Patent [19]

Nakamura et al.

[11] Patent Number: 5,746,584

[45] Date of Patent: May 5, 1998

[54] INNER CAM TYPE FUEL INJECTION PUMP HAVING MODIFIED PLUNGERS

[75] Inventors: Hisashi Nakamura; Kenichi Kubo; Jun Matsubara; Kazuaki Narikiyo; Hajime Machida; Noriyuki Abe; Tsunayoshi Motoyoshi; Atsushi Ueda, all of Higashimatsuyama, Japan

[73] Assignee: Zexel Corporation, Tokyo, Japan

[21] Appl. No.: 611,670

[22] Filed: Mar. 6, 1996

[30] Foreign Application Priority Data

Mar. 13, 1995 [JP] Japan ..... 7-080716

[51] Int. Cl.[6] ..... F04B 19/00

[52] U.S. Cl. ..... 417/273; 417/486; 417/487; 92/71; 92/172

[58] Field of Search ..... 417/273, 219, 417/221, 486, 510, 487; 92/72, 209, 172

[56] References Cited

U.S. PATENT DOCUMENTS

| | | | |
|---|---|---|---|
| 4,378,962 | 4/1983 | Law | 417/486 |
| 4,662,825 | 5/1987 | Djordjevic | 417/273 |
| 5,443,048 | 8/1995 | Nicol et al. | 417/486 |

FOREIGN PATENT DOCUMENTS

| | | | |
|---|---|---|---|
| 0 635 635 | 1/1995 | European Pat. Off. | 417/486 |
| 62-193173 | 12/1987 | Japan . | |
| 2 081 395 | 2/1982 | United Kingdom | 417/462 |

*Primary Examiner*—Charles G. Freay
*Assistant Examiner*—Cheryl J. Tyler
*Attorney, Agent, or Firm*—Wenderoth, Lind & Ponack

[57] ABSTRACT

In an inner cam type injection pump, the side surface of the protruding portion of each of the plungers facing the compression space is formed in a projecting shape in the area where the plunger changes from the base end side into the front end. Specific forms of the projection include a structure constituted with slanted surfaces over a plurality of stages with different inclinations relative to the axis of the plunger, an arc form and a structure provided with a overhanging portion formed on the side surface of the protruding portion, which does not overhang the base end, projecting out from the side surface. This will prevent collision at the shoulder portion of the plunger and, consequently, prevent the deformation at the shoulder portion and ensures that plungers will not have sliding failures or become seized. Even when plungers collide, the sliding of the plungers will not be affected, ensuring that plungers do not have sliding failures or become seized.

14 Claims, 6 Drawing Sheets

INNER CAM TYPE FUEL INJECTION PUMP HAVING MODIFIED PLUNGERS

BACKGROUND OF THE INVENTION

1. Field of the Invention

The present invention relates to an inner cam, distributor type injection pump which is employed for fuel supply to an engine or the like, i.e., a fuel injection pump which employs a system in which plungers are caused to make reciprocal movement in the direction of the radius of a rotor which rotates in synchronization with the engine.

2. Description of the Related Art

Inner cam, distributor type injection pumps in the prior art include the one disclosed in Japanese Unexamined Utility Model Publication No. S62-193173. In this injection pump, an inner cam is provided around a rotor which operates in synchronization with an engine and cam surfaces formed on the inside of this inner cam cause plungers to reciprocate in the direction of the radius of the rotor. In the rotor, a pump chamber and plunger cylinders which face this pump chamber are formed. Four plunger cylinders are formed on the same plane with their phases offset by 90° from one another, and the plungers that slide in the cylinders are lifted at the same time to compress the fuel inside the pump chamber.

In such a structure, in which four plungers are provided on the same plane, it is necessary to minimize the dead volume inside the pump chamber in order to assure high pressure fuel and, to achieve this, it is effective to form the portions that protrude into the pump chamber by narrowing the ends of the plungers toward the pump chamber in a cone shape and to make these protruding portions project out into the pump chamber at the maximum lift positions of the plungers, as disclosed in the publication mentioned above.

However, when the rotation rate of the drive shaft increases, the plungers jump from the inner cam when they are moved to an innermost position and adjacent plungers collide with each other. Since the protruding portions 7*a'* of the plungers 7' are formed in a cone shape, as shown in FIG. 7, the collisions occur at the shoulder portions 7*c'* of the plungers 7' where they change from their base portions 7*b'* into the protruding portions 7*a'*.

Such collisions of the plungers 7' result in surface deformation in the colliding areas and if such deformation occurs in a shoulder portion 7*c'*, the clearance between the plunger 7' and the inner surface of the plunger cylinder 6 (3~4 μm) cannot be maintained. This, in turn, may result in a sliding failure of the plunger 7' or in the worst case, the plunger 7' becoming seized to the rotor 3.

SUMMARY OF THE INVENTION

The object of the present invention is to provide an inner cam type injection pump in which the problems of the prior art discussed above are solved, so that even when plungers collide with each other, the sliding of the plungers is not affected and, thus, sliding failures do not occur in the plungers and they are prevented from becoming seized.

The applicants of the present invention, through extensive research into means for solving the problems discussed above, has completed the present invention based upon the observation that, when the plungers are made to collide toward the front ends of their protruding portions, but not at the shoulder portions, good sliding in the cylinder can be maintained even if the colliding areas become deformed.

Accordingly, the present invention is an inner cam type injection pump that includes a plurality of plunger cylinders provided on the same plane in the direction of the radius of a rotor, a compression space provided in the rotor facing the plunger cylinders and plungers provided in each of the plunger cylinders in such a manner that they can slide freely. An inner cam provided around the rotor regulates the movement of the plungers and a protruding portion, the cross section of which becomes smaller toward the front end, is formed at the end of each plunger that faces the compression space. In this injection pump, the side surface of the protruding portion is projected in the area where it changes from the base end side to the front end side.

In the injection pump, the projection may be constituted with slanted surfaces formed over a plurality of stages with different angles of inclination relative to the axis of the plunger, may take the form of an arc, or may be constituted by providing an overhanging portion on the side surface of the protruding portion that does not overhang the base end side, which projects out from the side surface.

Alternatively, instead of forming the side surface of the protruding portion with a projection, or with a combination of such projections, the base end side of the protruding portion may be formed with an indented shape.

Furthermore, the form of the protruding portion described above may be adopted in only some of the plungers in an inner cam type injection pump that includes a plurality of plunger cylinders provided on the same plane in the direction of the radius of the a rotor, a compression space provided in the rotor facing the plunger cylinders and plungers provided in each of the plunger cylinders in such a manner that they can slide freely, with a protruding portion having a cross section that becomes smaller toward the front end, formed at the end of each plunger, where it faces the compression space, in which the movement of the plungers is regulated by an inner cam provided around the rotor.

In this case, it is desirable to adopt the form mentioned earlier for the protruding portion in only one of each pair of adjacent plungers. More specifically, the form should be adopted in alternate plungers among a plurality of plungers provided in the direction of the circumference.

Consequently, when the rotor rotates, the plungers are lifted in the plunger cylinders to reduce the volumetric capacity of the compression space. Although the plungers jump and adjacent plungers collide with each other, since the side surface of each protruding portion has a projected form in the area where it changes from the base end side to the front end side, the plungers do not collide at the shoulder portions where they change to the protruding portions but collide at the areas toward the front end of the protruding portions. In other words, when the projected form at the side surface of each protruding portion is constituted with slanted surfaces formed over a plurality of stages, it is possible to make the collision occur at the slanted surface toward the front end or in the boundary area formed at the boundary between slanted surfaces. When the projected form is constituted with an arc, it is possible to make the collision occur around the center of the side surface of the protruding portion and when the projected form is constituted of an overhanging portion provided at the side surface of the protruding portion, it is possible to make the collision occur at this overhanging portion. In all these cases, it is possible to avoid having the collision occur at the base end (shoulder portion) of the protruding portions and, as a result, deformation of the base ends of the protruding portions can be avoided.

Furthermore, if the base end side of the protruding portion is formed with an indented shape, plungers will collide with each other in an area other than the area toward the base ends of the protruding portions. Thus, in this case too, deformation of the base ends of protruding portions can be prevented.

Moreover, of a plurality of plungers, the irregular protruding portion described above may be formed in only some, with the other plungers being plungers of the prior art. In this case, too, deformation of the base ends of the plungers with irregular protruding portions and the adjacent plungers can be prevented. For instance, if plungers with irregular protruding portions are provided at alternate positions, advantages similar to those achieved when irregular protruding portions are formed in all the plungers, can be achieved.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of the embodiments of the present invention in reference to the drawings.

Figure 1:
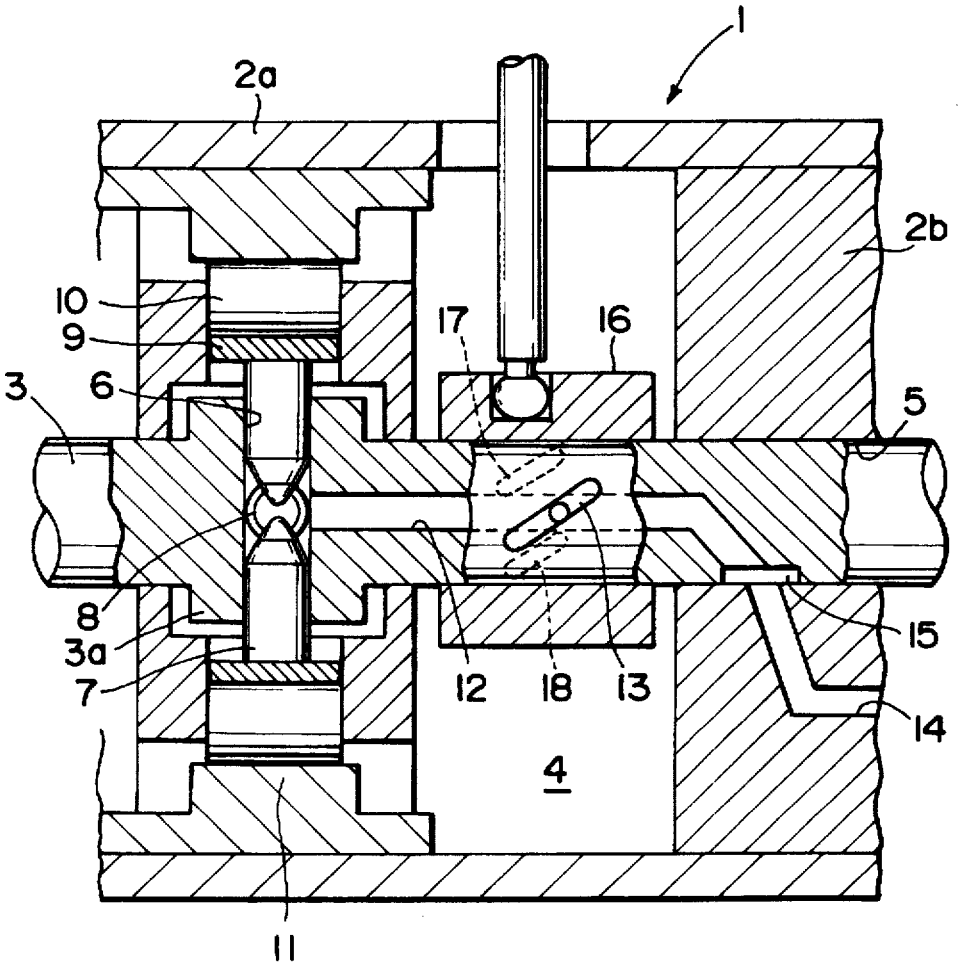
FIG. 1 is a schematic cross section of the essential portion of the inner cam type injection pump according to the present invention.

In FIG. 1, which shows the essential portion of an inner cam type distributor type fuel injection pump, a distributor type fuel injection pump 1 is provided with a rotor 3 inside pump housings 2*a* and 2*b*. This rotor 3, upon receiving drive torque from an engine (not shown), rotates in synchronization with the engine. The rotor 3 extends through a chamber 4 where fuel from a fuel tank is supplied via a feed pump.

Figure 2:
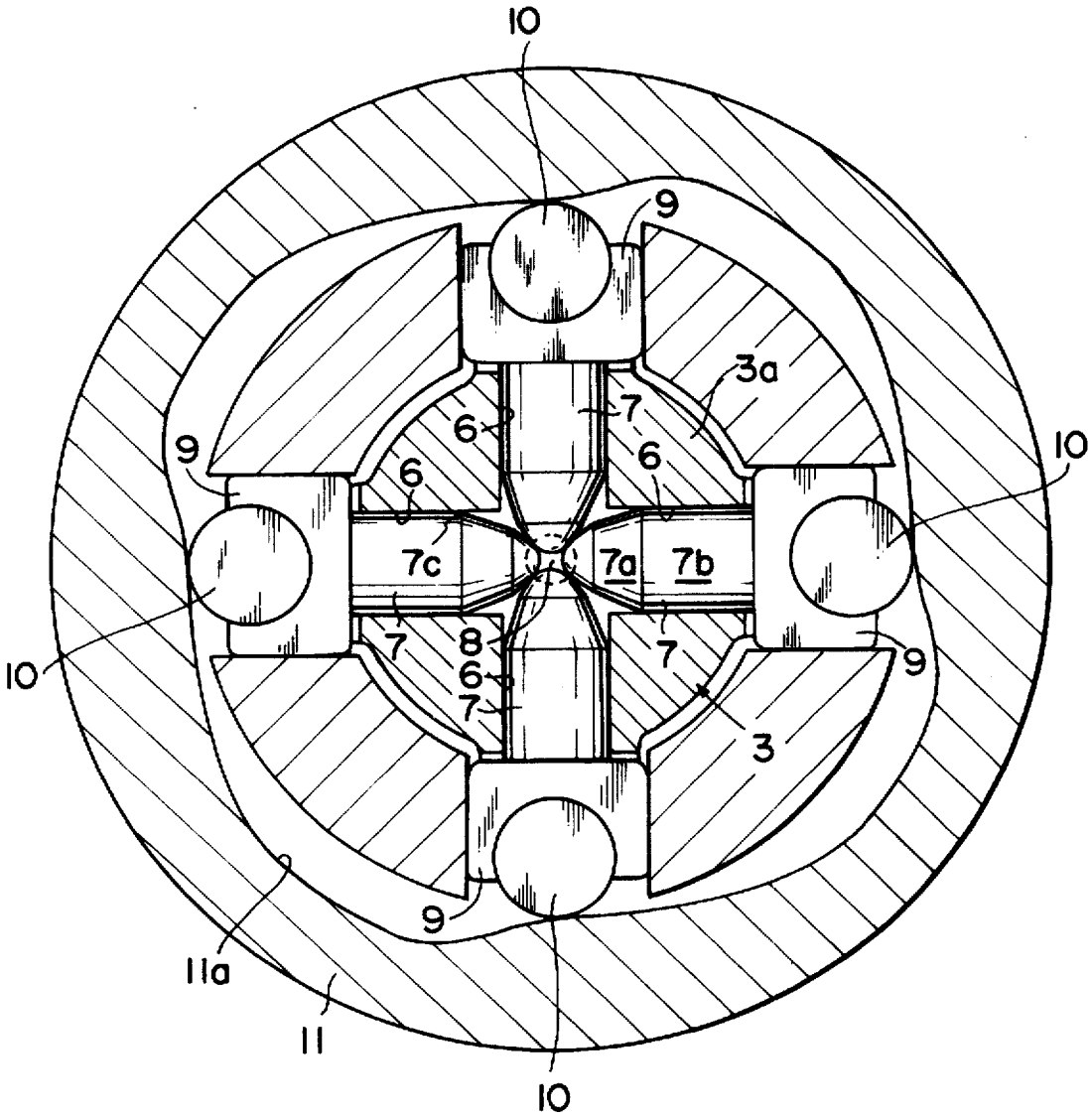
FIG. 2 is a cross section through a plane that includes all the plungers of the inner cam type injection pump shown in FIG. 1.

The front end of the rotor 3 is inserted into a barrel 5, which is formed at the pump housing 2*b*, in such a matter that it can rotate freely. A larger diameter portion 3*a* of the rater is formed toward its base portion, where plunger cylinders or bores are formed and extend in a direction of the radius (radial direction) are formed. In this embodiment, four plunger cylinders 6 are formed over 90° intervals, for instance, on the same plane, as shown in FIG. 2, and a plunger 7 is inserted in each plunger cylinder 6 in such a manner that it can slide freely.

The front end of each plunger 7 faces a compression space 8 provided at the center of the rotor 3 enclosing this space and the base end of the plungers 7 slide against the inner surface of a ring-like inner cam 11 via shoes 9 and rollers 10. The inner cam 11 is provided concentrically to and around the rotor 3 and is provided with cam surfaces 11*a*, the number of which corresponds to the number of cylinders in the engine. Thus, when the rotor rotates, each plunger 7 reciprocates in the direction of the radius of the rotor 3 (the radial direction) to change the volumetric capacity of the compression space 8.

In other words, an inner cam 11 which is formed in correspondence to four cylinders, for instance, is provided with projected surfaces every 90° on its inside, so that the four plungers 7 travel simultaneously toward the compression space 8 to compress the compression space 8 by constricting it and they travel simultaneously away from the compression space 8 to decompress it.

The rotor 3 is provided with a longitudinal hole 12 in the direction of the axis which communicates with the compression space 8, an inflow/outflow port 13 opening onto the external circumferential surface of the rotor at a position within the chamber 4, and a distribution port 15, which can communicate with a plurality of distribution passages 14 formed in the housing 2*b*. A sleeve 16 is externally fitted on the chamber 4 covering the inflow/outflow port 13 of the rotor 3 in such a manner that it can side freely. An intake hole 17 and a cutoff hole 18, both of which can communicate with the inflow/outflow port 13 are formed in the sleeve 16, and the timing with which the intake hole 17 or the cutoff hole 18 communicates with the inflow/outflow port 13 is adjusted by moving the sleeve 16 in the direction of the shaft axis.

Figure 3A:
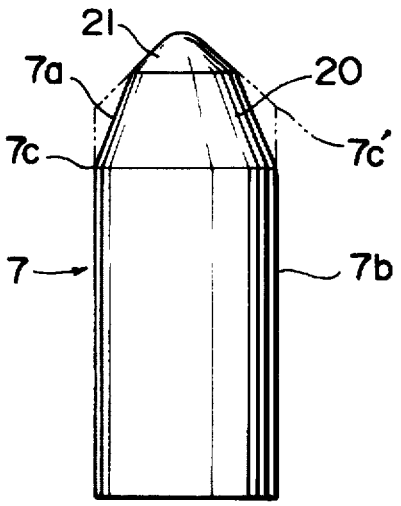
FIGS. 3A and 3B show one of the plungers used in the inner cam type injection pump according to the present invention, with FIG. 3A being a side view and FIG. 3B being a perspective view.
Figure 7:
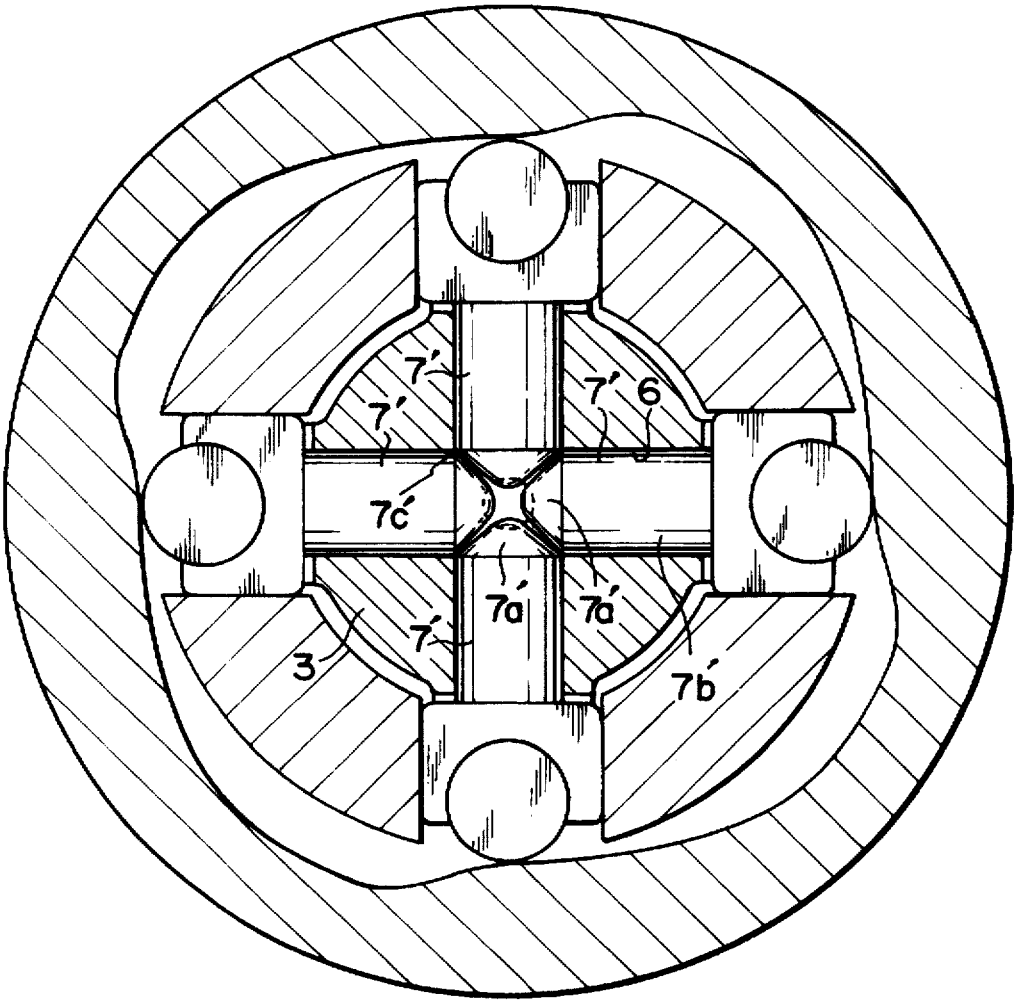
FIG. 7 PRIOR ART
FIG. 7 is a cross section of an inner cam type injection pump of the prior art.

The four plungers 7 which reciprocates in the plunger cylinders 6 are each provided with a protruding portion 7*a* whose cross section becomes smaller toward the front end, where it faces the compression space 8, as shown in FIGS. 3A and B. To describe the form of these plungers 7 in comparison with the form of the plungers in the prior art, as shown in FIG. 7, the plungers in the prior art have a cone shape, whereby the protruding portion 7*a'* protrudes out into the compression space 8 at the maximum lift position and the side surface of the protruding portion 7*a'* has an inclination of 45° or greater relative to the axis of the plunger, as indicated with the two-point chain line in FIG. 3A. In contrast, in each of the plungers 7 according to the present invention, a shoulder portion 7*c* (the area where the base portion 7*b* changes into the protruding portion 7*a*) is formed at a position further away from the front end and the protruding portion 7*a* is constituted with two slanted surfaces with different angles of inclination relative to the axis of the plunger 7 (a first slanted surface 20 and a second slanted surface 21), as indicated with the solid lines in FIGS. 2 and 3. The slanted surfaces 20 and 21, formed on the side surface of the protruding portion 7*a*, are formed in such a manner that the first slanted surface 20 toward the base end has an inclination smaller than 45° relative to the axis of the plunger 7 and the second slanted surface 21 toward the front end has an inclination of 45° or larger. By increasing the inclination of the slanted surface toward the front end relative to the axis of the plunger 7, the side surface of the protruding portion 7*a* is formed in an projected shape extending from the base end side toward the front end side.

As a result, when the rotor 6 rotates, the plungers 7 reciprocate in the plunger cylinders 6 of the rotor 3 in correspondence to the form of the inner cam 11 and during an intake process, in which the plungers 7 move in the direction away from the compression space 8, the inflow/ outflow port 13 and the intake hole 17 become aligned with each other and the fuel in the chamber 4 is taken into the compression space 8. Then, when the operation enters a force-feed process, in which the plungers 7 move toward the compression space 8, the communication between the intake hole 17 and the inflow/outflow port 13 is cut off, the distribution port 15 and one of the distribution passages 14 become aligned and compressed fuel is supplied to a delivery valve via this distribution passage 14. When the inflow/outflow port 13 and the cutoff hole 18 become aligned during the force-feed process, the compressed fuel flows out into the chamber 4 to end fuel injection.

If the rotor 3 is rotating at high speed, when the plungers 7 reach the maximum lift position at the cam apex, they jump, colliding with adjacent plungers 7 and then start to travel downward due to the fuel pressure inside the compression space 8. In the prior art, this collision occurs at the shoulder portions of the plungers, i.e., in the area where they change or transition from their base body portion **7*b* into the protruding portion 7*a*. With the plungers 7 according to the present invention, however, they collide at the slanted surfaces toward the front end (second slanted surfaces 21) or at the boundary area between the first slanted portion 20 and the second slanted portion 21. Thus, deformation caused by collision at the shoulder portion 7*c* of the plungers 7** can be prevented.

Figure 4A:
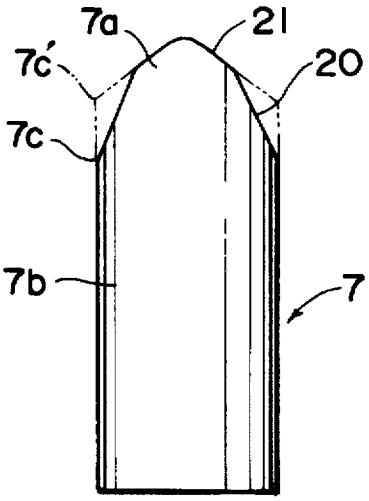
FIGS. 4A and 4B show another example of the plungers used in the inner cam type injection pump according to the present invention, with FIG. 4A being a side view and FIG. 4B being a perspective view.
Figure 4B:
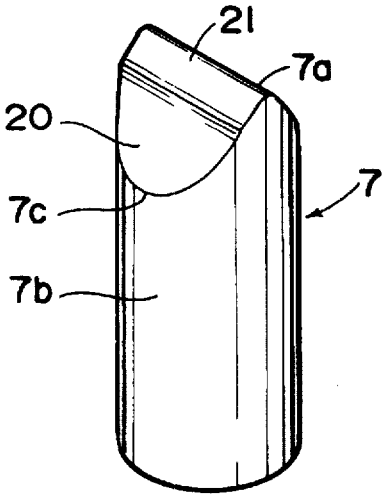

While the structure in which two slanted surfaces 20 and 21 with different angles of inclination are formed in the plunger 7 to form a projected shape on the side surface of the protruding portion **7*a* may be constituted with the two conical surfaces over two stages, as described above, it may also be constituted with slanted surfaces over two stages formed only in the area where the plungers collide with adjacent plungers, as shown in FIGS. 4A and 4B. In other words, no slanted surface is formed on the surface of that part of the base body portion 7*b* where collision does not occur, and which extends into the area of the compression space unmodified. Where adjacent plungers 7 collide with each other, the shoulder portion 7*c*' in the prior art (indicated with the two-point chain line) in each plunger is cut off with a first slanted surface 20 with its angle of inclination relative to the axis of the plunger 7 smaller than 45° formed toward the base end and a second slanted surface 21** with its angle of inclination at 45° or larger formed toward the front end separately.

In such a structure, it is necessary to provide a means for ensuring that the plungers 7 do not rotate around their axes and, for this purpose, a means for preventing rotation such as that disclosed in Japanese Unexamined Utility Model Publication No. S62-193173, for instance, may be employed without presenting any problems in achieving advantages similar to those achieved in the embodiment described above.

Figure 5A:
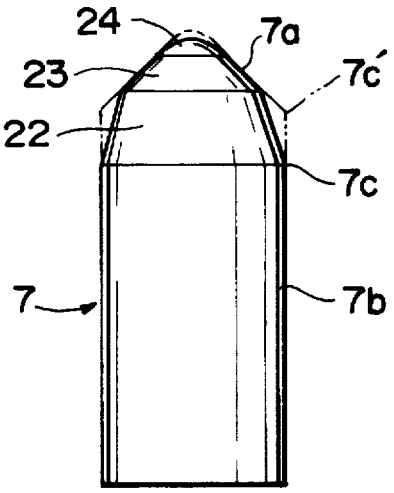
FIGS. 5A~5D show yet other examples of plungers used in the inner cam type injection pump according to the present invention.
Figure 5B:
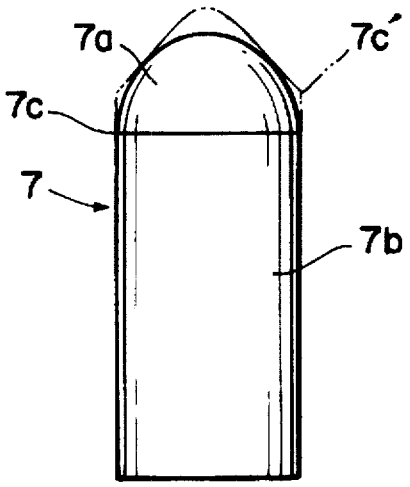
Figure 5C:
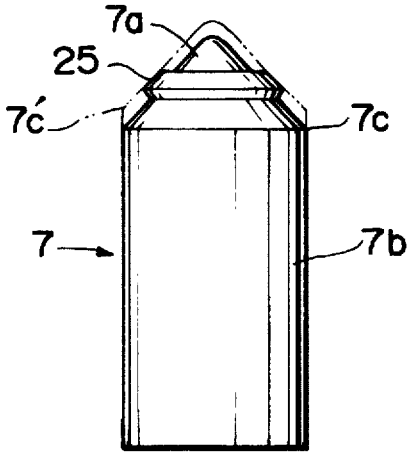
Figure 5D:
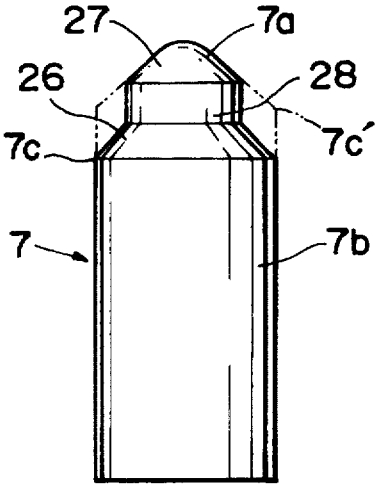

Other structures in which the side surface of the protruding portion **7*a* is formed projecting from the base end side toward the front end side include those shown in FIGS. 5A, 5B and 5D**.

In FIG. 5A, the shoulder portion **7*c*' of the plunger 7 (where the plunger 7 changes from the base body portion 7*b* into the protruding portion 7*a*) is formed at a position further away from the front end compared to the shoulder portion 7*c* in the prior art, indicated with the two-point chain line, and the protruding portion 7*a* is constituted with three slanted surfaces (first slanted surface 22, second slanted surface 23, third slanted surface 24) with different angles of inclination relative to the axis of the plunger 7. The slanted surfaces 22, 23, and 24 formed on the side surface of the protruding portion 7*a* are formed in such a manner that the inclination of the first slanted surface 22 toward the base end is less than 45° relative to the axis of the plunger 7, the inclinations of the second and third slanted surfaces 23 and 24 toward the front end are at 45° or more, for instance. By making the angle of inclination relative to the axis of the plunger 7 larger for the slanted surface that is closer to the front end, the side surface the protruding portion 7*a*** is formed projecting from the base end toward the front end.

In such a structure, when the plunger 7 jumps and collides with the adjacent plungers 7, the collision will occur at the second slanted surface 23 or the third slanted surface 24, or at the boundary area between the first slanted surface 22 and the second slanted surface 23 or at the boundary area between the second slanted surface 23 and the third slanted surface 24. Thus, deformation caused by collision occurring at the shoulder portion **7*c* of the plunger 7** can be prevented.

Also, in FIG. 5B, the shoulder portion **7*c* of the plunger 7 (the area where the plunger 7 changes from the base body portion 7*b* into the protruding portion 7*a*) is formed at a position further away from the front end compared to the shoulder portion 7*c*' in the prior art, indicated with the two-point chain line in FIG. 5B, so that the protruding portion 7*a* is formed in a near hemispherical shape with its cross section gradually becoming smaller toward the front end. In addition, its side surface is formed in such a manner that it has an inclination of less than 45° relative to the axis of plunger 7** toward the base end and it has an inclination of 45° or more toward the front end, achieving a smooth projecting surface extending from the base end side toward the front end side.

In such a structure, too, when the plunger 7 jumps, it will collide with the adjacent plungers 7 in the area toward the front end, away from the base end of the protruding portion **7*a* and, as a result, deformation in the shoulder portion 7*c* of the plunger 7** can be prevented.

Moreover, the projected form on the side surface of the protruding portion may be constituted by providing an overhanging portion 25 that does not overhang the base end side to accommodate collision on the side surface of the protruding portion **7*a*, as shown in FIG. 5C. To be more specific, a ring-like overhanging portion 25 is formed as part of the protruding portion 7*a*, which is formed in a cone shape, at approximately the middle of the protruding portion 7*a*, and the shoulder portion 7*c* of the plunger 7 (the area where the plunger 7 changes from the base body portion 7*b* into the protruding portion 7*a*) is formed at a position further away from the front end compared to the shoulder portion 7*c*'** in the prior art, indicated with the two-point chain line.

In such a structure, adjacent plungers 7 collide with each other at their overhanging portions 25 and, as a result, collision at the shoulder portions **7*c* of the plungers 7 is prevented and the shoulder portions 7*c*** are not deformed.

Rather than preventing a collision at the plunger shoulder portion **7*c* by constituting the protruding portion 7*a* of the plunger 7 with a projecting form, as in the structures described so far, the base end side of the protruding portion 7*a*, where collision is likely to occur, may be have an indented shape to avoid collision in that area. A typical example of such a structure is provided with a first slanted surface 26 formed in such a manner that the shoulder portion 7*c* is formed at a position further away from the front end compared to the plunger form in the prior art, indicated with the two-point chain line, and a second slanted surface 27 formed more toward the front end compared to the first slanted surface 26 with a cylindrical surface 28 connecting the two slanted surfaces. As another structural example, a circular groove may be formed in order to remove the shoulder portion 7***c'* of the plunger 7 in the prior art, indicated with the two-point chain line.

In these structures, even when adjacent plungers 7 collide with each other, the collision will not occur at shoulder portion 7*c* and thus it is possible to prevent deformation of the shoulder portion 7*c*, as in the embodiments described earlier.

Figure 6:
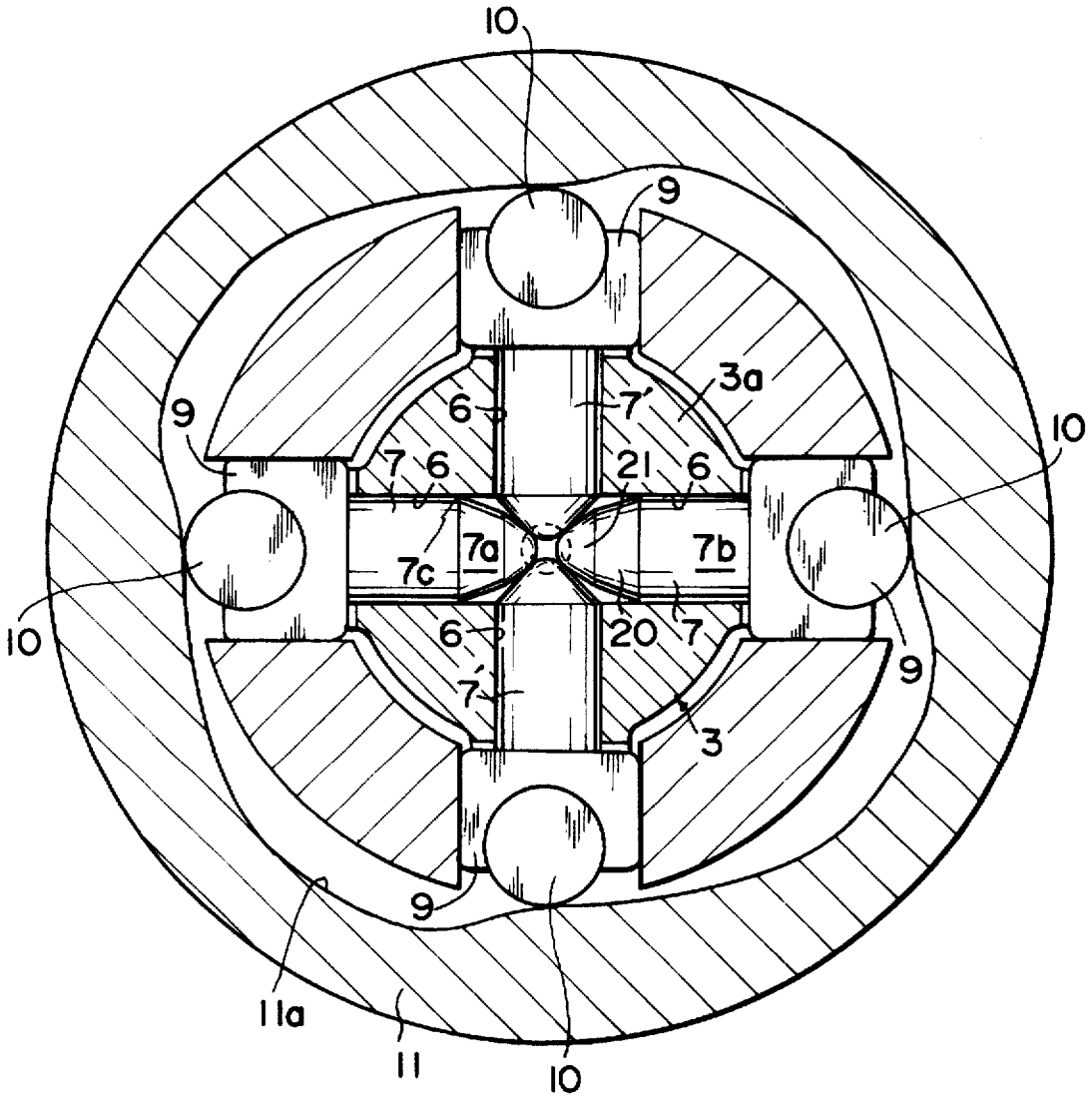
FIG. 6 is a cross section showing a state in which alternate plungers in an inner cam type injection pump have different forms.

FIG. 6 shows another embodiment of the present invention. The same reference numbers are assigned to identical components with their explanation omitted, and the explanation will be given only of components that are different.

Figure 3B:
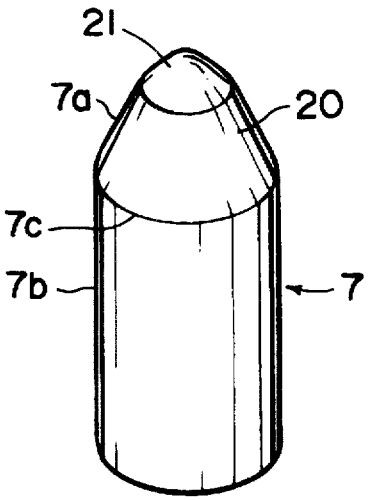

In this embodiment, some of the plungers 7 are constituted with any one of the plungers shown in FIGS. 3~5 and the remaining plungers are constituted with the plungers 7' of the prior art. More specifically, it has a structure in which plungers 7, each provided with a protruding portion with conical surfaces over two stages, as shown in FIG. 3, and plungers 7' of the prior art are provided alternately in plunger cylinders 6, for instance.

In this structure, when the plungers 7 and 7' jump and collide with adjacent plungers, the collision will not occur at the shoulder portion in any of the plungers 7 and 7', as shown in FIG. 6. Rather, the plunger 7' in the prior art will collide at the slanted surface (second slanted surface 21) toward the front end of the plunger 7 according to the present invention or at the boundary area between the first slanted surface 20 and the second slanted surface 21 and, as a result, deformation at the shoulder portion of each plunger is prevented. Note that, although in this embodiment, a specific structure employing the plungers shown in FIG. 3 is explained, a similar structure may be constituted by using any of the plungers 7, shown in FIG. 4 or FIG. 5 and in that case, too, collisions at the shoulder portion can be avoided in the same manner, preventing deformation at the shoulder portion of the plunger.

As has been explained, according to the present invention, since the side surface formed at the protruding portion of a plunger is made to have a projecting form in the area where it changes from the base end side toward the front end side, even when plungers collide with each other, the collision will not occur at the base end (shoulder portion) of the protruding portion and, as a result, deformation of the base end is prevented, to ensure that plungers will not have sliding failures or will not become seized.

The structure in which collisions do not occur at the base end of the protruding portion may be achieved by constituting the base end of the protruding portion with an indentation and in this case, too, deformation at the base end is prevented, to ensure that plungers will not have sliding failures or become seized.

Moreover, in a structure in which all plungers are not formed identically, with the protruding portions of some plungers being constituted with projected side surfaces or the base ends of the protruding portions being constituted with an indented shape, collisions of the plunger provided with a regular protruding portion and an adjacent plunger are made to occur in an area away from the base end, preventing deformation of the base end of the protruding portion in the same manner, and ensuring that plungers will not have sliding failures or become seized.

What is claimed is:

1. An inner cam type injection pump comprising:

a pump housing;

a rotor rotatably supported in said pump housing, said rotor defining an interior compression space, a fluid passage communicating with said compression space to allow fluid to flow in and out of said compression space, and a plurality of plunger cylinders extending radially from said compression space and lying in a common radial plane, said plunger cylinders being uniformly spaced about a central axis of said rotor and each of said plunger cylinders has a first end remote from said compression space and a second end opening into said compression space;

a plurality of plungers slidably disposed in said plunger cylinders, respectively, each of said plungers comprising a base portion disposed in sliding contact with an inner surface of said respective plunger cylinder, and a protruding portion extending inwardly from said base portion, wherein a shoulder portion is formed on each of said plungers by a transition from said base portion to said protruding portion, each of said protruding portions has a cross section which becomes smaller toward a front end thereof so as to prevent collisions between shoulder portions of said plungers, and said plungers which are oppositely disposed have the same shape;

and an inner cam concentrically disposed about said rotor, said inner cam having a cam surface formed on an inner side thereof for engaging said plungers to, upon rotation of said rotor, simultaneously move said plungers toward said compression space to an innermost position, wherein each of said shoulder portions of said plungers is located within said respective cylinder and is spaced from said second end of said respective cylinder at said innermost position, and said plungers are shaped to contact only at said front ends having said smaller cross section when at said innermost position.

2. The inner cam type injection pump as claimed in claim 1, wherein said protruding portion has an outer peripheral surface which defines a plurality of slanted annular surfaces over a plurality of stages, and an angle of inclination of said slanted annular surfaces becomes larger in a direction toward a front end of said protruding portion.

3. The inner cam type injection pump as claimed in claim 1, wherein each of said protruding portions has an outer peripheral surface which defines a first annular slanted surface extending from said shoulder and a second annular slanted surface extending from said first annular slanted surface, said first annular slanted surface forming an angle of inclination which is less than 45 degrees relative to a central axis of said plunger, and said second annular slanted surface forming an angle of inclination which is greater than 45 degrees relative to the central axis of said plunger.

4. The inner cam type injection pump as claimed in claim 1, wherein each of said protruding portions comprises:

a first slanted surface extending from said base portion;

a second slanted surface extending from said base portion, said second slanted surface being disposed on an opposite side of said protruding portion relative to said first slanted surface; and opposing portions, forming extensions of said base end portion, disposed between said first and second annular portions, wherein each of said first and second slanted surfaces define a first inclination extending from said base portion and form an angle which is less than 45 degrees relative to a central axis of said respective plunger, and a second inclination extending from said first inclination and forming an angle which is greater than 45 degrees relative to the central axis of said respective plunger.

5. The inner cam type injection pump as claimed in claim 1, wherein each of said protruding portions comprises:

a first slanted surface extending from said base portion;

a second slanted surface extending from said first slanted surface; and a third slanted surface extending from said second slanted surface, wherein said first slanted surface forms a first angle which is less than 45 degrees relative to a central axis of said respective plunger, said second slanted surface forms a second angle which is greater than 45 degrees relative to the central axis of said respective plunger, and said third slanted surface forms a third angle which is greater than 45 degrees relative to the central axis of said respective plunger, and said third angle is greater than said second angle.

6. The inner cam type injection pump as claimed in claim 1, wherein each of said protruding portions has an outer peripheral surface which forms an arc which has an inclination, relative to a central axis of said respective plunger, which becomes gradually larger in a direction toward said front end of said protruding portion.

7. The inner cam type injection pump as claimed in claim 1, wherein each of said protruding portions comprises an overhanging portion projecting from a side surface of said protruding portion, and said overhanging portion does not completely overhang a base end side of said protruding portion.

8. The inner cam type injection pump as claimed in claim 7, wherein said each of said protruding portions is formed as a cone and said overhanging portion is a ring-like structure projecting from a middle portion of said cone.

9. An inner cam type injection pump comprising:

a pump housing;

a rotor rotatably supported in said pump housing, said rotor defining an interior compression space, a fluid passage communicating with said compression space to allow fluid to flow in and out of said compression space, and a plurality of plunger cylinders extending radially from said compression space and lying in a common radial plane, said plunger cylinders being uniformly spaced about a central axis of said rotor and each of said plunger cylinders has a first end remote from said compression space and a second end opening into said compression space;

a plurality of plungers slidably disposed in said plunger cylinders, respectively, each of said plungers comprising a base portion disposed in sliding contact with an inner surface of said respective plunger cylinder, and a protruding portion extending inwardly from said base portion, wherein a shoulder portion is formed on each of said plungers by a transition from said base portion to said protruding portion, each of said protruding portions has a cross section which becomes smaller toward a front end thereof so as to prevent collisions between shoulder portions of said plungers which are disposed adjacent to each other, each of said protruding portions includes an indentation disposed between a front end and a rear end thereof, and at least said plungers which are diametrically opposed have the same shape; and an inner cam concentrically disposed about said rotor, said inner cam having a cam surface formed on an inner side thereof for engaging said plungers and, upon rotation of said rotor, simultaneously move said plungers toward said compression space to an innermost position, wherein said shoulder portion of each of said plungers are located within said respective cylinder and are spaced from said second end of said respective cylinder at said innermost position, and said plungers are shaped to contact only at said front ends having said smaller cross section when at said innermost position.

10. The inner cam type injection pump as claimed in claim 9, wherein each of said protruding portions comprises a first slanted surface ex tending from base portion, a second slanted surface at said front end, and an intermediate surf ace extending a long a direction of a central axis of said respective plunger, said intermediate surface interconnecting said first slanted surface and said second slanted surface.

11. The inner cam type injection pump as claimed in claim 9, wherein less than all of said plungers are formed with an indentation.

12. The inner cam type injection pump as claimed in claim 11, wherein said plungers which are formed with said indentation are alternately disposed with said plungers which are not formed with said indentation.

13. An inner cam type injection pump comprising:

a pump housing;

a rotor rotatably supported in said pump housing, said rotor defining an interior compression space, a fluid passage communicating with said compression space to allow fluid to flow in and out of said compression space, and a plurality of plunger cylinders extending radially from said compression space and lying in a common radial plane, said plunger cylinders being uniformly spaced about a central axis of said rotor and each of said plunger cylinders has a first end remote from said compression space and a second end opening into said compression space;

a plurality of plungers slidably disposed in said plunger cylinders, respectively, each of said plungers comprising a base portion disposed in sliding contact with an inner surface of said respective plunger cylinder, and a protruding portion extending inwardly from said base portion, wherein a shoulder portion is formed on each of said plungers by a transition from said base portion to said protruding portion, each of said protruding portions of said plungers have a cross section which becomes smaller toward a front end thereof, and said plungers which are oppositely disposed in said rotor have the same shape; and an inner cam concentrically disposed about said rotor, said inner cam having a cam surface formed on an inner side thereof for engaging said plungers to, upon rotation of said rotor, simultaneously move said plungers toward said compression space to an innermost position, wherein each of said shoulder portions of at least half of said plungers is located within said respective cylinder and is spaced from said second end of said respective cylinder at said innermost position so as to prevent collisions between shoulder portions of said plunders, and said plungers are shaped to contact only at said front ends having said smaller cross section when at said innermost position.

14. The inner cam type injection pump as claimed in claim 13, wherein said plungers having shoulder portions spaced from said second end of said cylinder are disposed alternately with the other of said plungers.

* * * * *